United States Patent [19]

Barkan

[11] 3,991,396

[45] Nov. 9, 1976

[54] ELECTRIC CIRCUIT PROTECTOR COMPRISING PARALLEL-CONNECTED LIQUID-METAL CURRENT-LIMITING DEVICES

[75] Inventor: Philip Barkan, Media, Pa.

[73] Assignee: General Electric Company, Philadelphia, Pa.

[22] Filed: May 7, 1975

[21] Appl. No.: 575,273

[52] U.S. Cl. ..... 337/114; 357/82

[51] Int. Cl.[2] ..... H01H 87/00

[58] Field of Search ..... 337/114; 357/82

[56] References Cited

UNITED STATES PATENTS 3,902,150 8/1975 Wada et al. ..... 337/114

*Primary Examiner*—Harold Broome

*Attorney, Agent, or Firm*—J. Wesley Haubner; William Freedman

[57] ABSTRACT

A liquid-metal circuit protector comprises two liquid-metal current limiting devices electrically connected in parallel with each other. Each current limiting device comprises a pair of spaced terminals and a passageway extending between said terminals and containing liquid metal. The passageways are hydraulically connected in series in a hydraulic circuit loop. Pumping means operated by current through the protector forces liquid metal around the loop via each of the passageways, and heat exchange means external to the passageways cools the liquid metal during its flow through the loop.

8 Claims, 4 Drawing Figures

ELECTRIC CIRCUIT PROTECTOR COMPRISING PARALLEL-CONNECTED LIQUID-METAL CURRENT-LIMITING DEVICES

BACKGROUND

This invention relates to an electric circuit protector that comprises a plurality of liquid-metal type current-limiting devices and, more particularly, relates to a circuit protector of this character which is capable both of carrying high continuous currents and of effectively limiting letthrough currents under fault conditions.

Examples of liquid-metal current-limiting devices are disclosed in U.S. Pat. Nos. 3,117,203-Hurtle; 3,389,359-Harris; and 3,501,730-Ito et al. These devices typically carry continuous current through a column of liquid metal which has a low resistance at normal temperatures. When a fault current flows through the column, a portion of the liquid metal is abruptly vaporized into a high-pressure vapor by the high temperature resulting from the fault current, and this vapor has a high resistivity that limits the fault current. Thereafter, the vaporized metal is allowed to cool and return to its liquid state so that it recovers its original low resistance, thus permitting reuse of the current-limiting device.

Current-limiting devices of the above type are capable of limiting the maximum instantaneous peak value of the current permitted to flow (i.e., the maximum let-through current) to a value considerably lower than the maximum instantaneous peak value which would have been carried by the device had it retained its normal impedance (i.e., the maximum prospective current), as illustrated, for example, in FIG. 9 of the aforesaid Hurtle patent.

Most current-limiting devices, even silver-sand current limiting fuses, are characterized by reduced effectiveness in their current-limiting action and the continuous current rating of the device increases. Accordingly, as a general rule, the higher the continuous current rating of the currentlimiting device, the higher will be the let-through current for a given prospective fault current. Insofar as I am aware, for continuous current ratings of 2,000 or 3,000 amperes, no effective current-limiting protection is presently available.

In a current-limiting device that comprises a conducting element that changes in phase in response to fault currents, current-limiting effectiveness can be increased by providing the conductive element with a zone of restricted cross-section having a relatively high resistance and a relatively low mass (and hence a relatively low thermal capacity). This high resistance and low thermal capacity accelerate melting and/or vaporization of the restricted cross-section portion in response to a fault-current initiation, thereby accelerating current-limiting action. But there high resistance can produce overheating under high continuous current conditions, thus interfering with the ability of the conductive elements to carry high continuous currents. Higher continuous current-carrying ability can be obtained by effectively cooling the restricted zone of the conductive element under continuous current conditions.

SUMMARY

An object of my invention is to provide a liquid metal current-limiting device that has new and exceptionally effective means for cooling its zone of restricted cross-section during continuous current conditions.

Another object is to provide cooling means for the restricted cross-section zone of a liquid-metal current-limiting device that has an effectiveness that increases as a direct function of the magnitude of the continuous current through this zone.

Another object is to effect intense cooling of the zone of restricted cross-section by pumping the current-carrying liquid metal itself through the current-limiting device.

Another object is to effect such cooling by pumping the liquid metal around a circuit loop that is so constructed that the liquid metal flowing externally of the current-limiting device between its terminals does not detrimentally short out the current-limiting device.

In carrying out the invention in one form, I provide a liquid-metal electric circuit protector comprising a plurality of liquid-metal current-limiting devices electrically connected in parallel circuit relationship with each other. Each current-limiting device comprises a tubular housing of electrical insulating material, a pair of spaced electrical terminals at opposite ends of the housing, and a passageway extending through the housing between the spaced terminals. A supply of liquid metal which has a relatively low electrical resistivity in liquid state and a relatively high electrical resistivity in its vaporized state is contained within the protector, and a portion of this supply is normally located within each of said passageways for normally carrying current between the spaced terminals of each of the current-limiting devices and for vaporizing when shortcircuit current flows between the terminals. Means is provided for hydraulically connecting said passageways in series in a hydraulic circuit loop. Pumping means hydraulically connected in this loop and operated by current through the protector during continuous-current conditions forces said liquid metal around said loop via each of said passageways. External to said passageways heat exchange means is provided for cooling the liquid metal during its flow through said loop.

BRIEF DESCRIPTION OF DRAWINGS

For a better understanding of the invention, reference may be had to the drawings, wherein.

DETAILED DESCRIPTION OF PREFERRED EMBODIMENT

Figure 1:
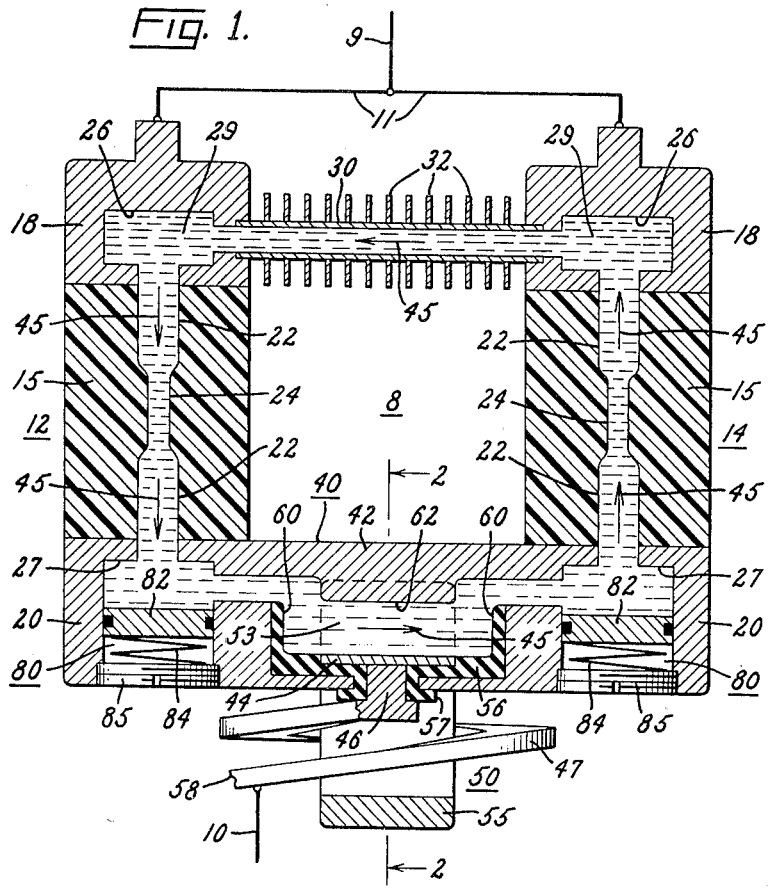
FIG. 1 is a schematic showing partially in section of a circuit protector embodying one form of the invention.

Referring now to FIG. 1, there is shown a circuit protector 8 comprising two spaced-apart electrical terminals 9 and 10 and two liquid-metal current-limiting devices 12 and 14 that are electrically connected in parallel circuit relationship with each other between terminals 9 and 10. Each current-limiting device comprises a tubular housing 15 of electrical insulating material, a pair of spaced-apart metal terminals 18 and 20 at opposite ends of the housing 15, and a passageway 22 extending longitudinally of the housing 15 between the spaced terminals. The passageway 22 contains a zone 24 of restricted cross-section, the purpose of which will soon be described. The terminals 18 and 20 respectively contain cavities 26 and 27 that communicate with the passageway 22.

The circuit interrupter includes a supply 29 of liquid metal which normally completely fills the passageways 22 and the cavities 26 and 27 of the current-limiting devices. Suitable liquid metals for this application are mercury, or a potassium-sodium eutectic alloy or a potassium-sodium-cesium eutectic alloy. These metals are characterized by relatively low resistivities when in the liquid phase and relatively high resistivities when in the vapor phase and pressurized.

The upper terminals 18 of the current-limiting devices are hydraulically interconnected by a horizontally-extending metal tube 30. Radially-extending metal fins are integrally joined to the tube 30 so that structure 30, 32 is capable of serving as an efficient heat exchanger for transferring heat from the liquid metal to the surrounding atmosphere, as will soon be described in more detail.

The cavities 27 in the lower terminals are hydraulically interconnected by a conduit 40 that extends horizontally between the cavities. It will thus be apparent that there is present in the circuit protector a hydraulic circuit loop that extends in series through the left-hand passageway 22, lower conduit 40, the right-hand passageway 22, and tube 30. As will soon appear more clearly, whenever the circuit protector is carrying current, liquid metal is being pumped through this hydraulic circuit loop in the direction of arrows 45 in FIG. 1. The portion of this circuit loop external to a given current limiter may be considered as return means for the liquid metal passing through said current limiter.

Under normal continuous-current conditions, current flows between terminals 9 and 10 of the protector via the parallel conductive paths provided by the liquid metal in the two current-limiting devices 12 and 14. More specifically, current flows between terminal 9 and the currentlimiting devices through a conductor 11 interconnecting the upper terminals 18 of the current-limiting devices. Current through each current-limiting device follows a path that passes successively through upper terminal 18, liquid metal in cavity 26, liquid metal in passageway 22, liquid metal in cavity 27, and lower terminal 20. Most of the current flowing from lower terminal 20 to protector terminal 10 follows a path through the upper portion 42 of conduit 40 through the central region of the conduit, then vertically across the liquid in conduit 40 to an electrode 44, then through a stud 46 and a coil 47 to terminal 10.

If a fault should develop on the electrical circuit in which the protector 8 is connected, current through the protector will abruptly increase, rising rapidly toward a maximum prospective value. This abrupt increase in current produces rapid heating and resultant vaporization of the liquid metal in the restricted zone 24 of each passageway 22, replacing the liquid in zone 24 with high-pressure vapor. This vapor has a relatively high resistance that is effective to limit the let-through current to a value far below the maximum prospective value. Such current-limiting action is described in more detail in the above cited patents and elsewhere in the prior art.

Although I prefer to utilize a restricted zone 24 which extends along only a portion of the length of each passageway 22, the invention in its broader aspects comprehends current limiters in which this passageway is restricted throughout a major portion, or even all, of its length. The size (length and cross-section) of the restricted zone is an important determinant of the flow impedance, the continuous current rating, and the arc voltage characteristics of the current limiter.

It is to be understood that the circuit protector 8 is not required to completely interrupt the circuit in the event of a fault. Final interruption can be delegated to a slower acting switch or circuit breaker (not shown) in series with the protector which acts to interrupt the reduced current flowing after the fault current has been limited by the current limiting devices. In one application of the invention, a resistor of appropriate size can be provided in parallel with the circuit protector 8, as in my joint U.S. Pat. No. 3,873,887, assigned to the assignee of the present invention. Current is diverted into this resistor by operation of the current limiters and is thereafter interrupted by a suitable circuit breaker of low interrupting rating in series with the protector.

The high pressures developed in the restricted zones 24 during operation of the protector 8 are limited to nondestructive values by pressure-relief means 80 located in the lower terminals 20 of each current limiter. Each pressure relief means 80 comprises a piston 82 biased upwardly in a closely-fitting cylindrical chamber by a compression spring 84 seated on an adjustable cap 85 screwed in terminal 20. The compression of spring 84 determines the pressure that will normally be maintained on the liquid metal system. When liquid metal is vaporized at restricted zone 24, the piston and the spring yield in a downward direction when the pressure reaches a predetermined level, thus limiting the resulting pressure to a non-destructive value.

Although the illustrated protector 8 has pressure-relief means (80) located only in the lower terminals 20, it will be apparent that similar pressure-relief means can also be provided in the upper terminals 18 where needed to protect against damage from the pressure developed by liquid-metal vaporization during short circuit conditions.

For pumping liquid metal around the above-described hydraulic circuit loop, an electromagnetic pump 50 is provided in the lower conduit 40. The usual electromagnetic pump (examples of which are shown in my U.S. Pat. No. 3,654,528 and in my joint U.S. Pat. No. 3,812,404) comprises a channel containing conductive liquid, means providing a magnetic field transversely of the channel through the conductive liquid, and means for conducting current through the liquid in a direction perpendicular to the magnetic field. The current and the magnetic field interact in a known manner to develop a pressure gradient in the conductive liquid which forces the liquid along the channel in a direction perpendicular to the magnetic field and direction of the current.

My electromagnetic pump 50 operates in generally this manner and comprises current-directing means for forcing most of the electric current flowing through the interrupter to follow a path that extends vertically through the conductive liquid in channel 53 of conduit 40. This current-directing means comprises the electrode 44 that is positioned at the bottom of the channel 53 and is of an elongated bar-form with its longitudinal dimension extending axially of the channel. Integral with electrode 44 is the conductive stud 46 that extends through the bottom wall of the conduit 40. The coil 47, which serves to generate the magnetic flux used in the pump, is joined to the conductive stud 46 at its lowermost end. This coil 47 encircles one leg of a U-shaped iron core 55 and has an outer end 58 connected to terminal 10 of the protector assembly. Preferably, coil 47 is coated with electrical insulation 48.

Figure 2:
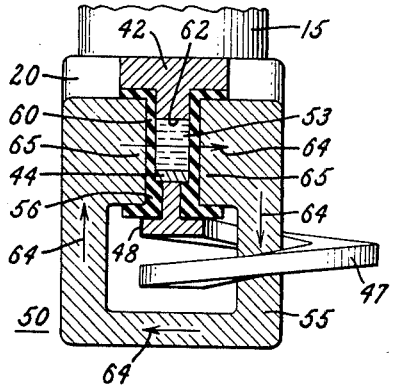
FIG. 2 is a sectional view taken along the line 2—2 of FIG. 1.

Substantially all of the current that flows downwardly through the protector assembly can enter coil 47 only through electrode 44 and stud 46 since the coil 47 is otherwise electrically insulated from the remainder of the protector assembly. In this respect, note in FIGS. 1 and 2 that the periphery of stud 46 is completely surrounded by electrical insulation 56 and that a portion 57 of the insulation is disposed between the upper surface of coil 47 and conduit 40. Such insulation allows current to enter the stud 46 and coil 47 only through electrode 44. Additional electrical insulation allows current to enter electrode 44, for the most part, only via a path that extends vertically across the channel 53 through the conductive liquid therein. This additional insulation comprises portions 60, which line the vertical walls of channel 53, and a portion of insulation 56 which extends beneath the electrode 44. The top wall 62 of channel 53 is free of electrical insulation and thus nearly all of the current enters the conductive liquid only through the top wall 62. This top wall portion 62 may be considered as one of the electrodes of the pump 50. The current entering through top wall 62, for the most part, flows downwardly through the conductive liquid in channel 53, exiting through electrode 44.

A mentioned hereinabove, the magnetic field for the electromagnetic pump 50 is developed by current flowing through coil 47. This current develops magnetic flux which follows a path, indicated by arrows 64 in FIG. 2, through a magnetic circuit comprising the U-shaped magnetic core 55, the iron pole pieces 65, and the gap between the pole pieces 65 formed by channel 53. This flux follows a path across channel 53 which extends substantially horizontally. Since, as previously described, the electric current through the conductive liquid in channel 53 follows a vertically-extending path, the flux and the current are able to interact to force the conductive liquid in channel 53 longitudinally thereof toward the right in FIG. 1. It is noted that no current flows through the core 55 inasmuch as this core is insulated from conduit 40 and coil 47.

Generally speaking, the rate at which pump 50 drives liquid through channel 53 varies directly with the product of the current between electrodes 62 and 44 and the transverse flux. Thus, the higher the current, the higher will be the pumping rate.

Although the illustrated embodiment of the pump 50 relies primarily upon electrical insulating material for forcing most of the current therethrough to follow a path that extends vertically between electrodes 62 and 44, it is to be understood that the desired current direction can also be achieved by utilizing for appropriate portions of the conduit 40 high resistivity metal, such as stainless steel, kept as thin as practical. In such a modified embodiment, the upper portion 42 of conduit 40 remains of high conductivity metal, such as copper, to promote current flow therethrough to and from upper electrode 62.

In a conventional liquid-metal current limiter, the liquid metal in the passageway (such as 22) of the limiter remains stationary during normal continuous-current conditions, and the only way of cooling the metal in the restricted portion of the passageway is by conduction, principally in a radial direction. Typically, such radial conduction must take place through a ceramic material and through several interfaces and, as a result, is relatively ineffective in cooling the liquid metal. Moreover, because the restricted portion of the fuse passage is kept small in cross-section (in order to provide the desired current-limiting action upon fault initiation), only a relatively small surface area is available for conducting heat from the liquid metal, thus further detracting from cooling efficiency. As a result of this inefficient cooling in prior liquid-metal devices, the continuous-current rating of these devices must be restricted to relatively low values in order to prevent undesired overheating.

I am able to provide much higher continuous-current ratings with my current limiter than was provided with these prior current limiters because I introduce an additional and much more effective cooling mode, namely convection, for extracting heat from the liquid in the restricted zone 24 of each passageway 22. The pump 50 by forcing liquid through passageway 22 removes heated liquid from zone 24 and replaces it with cooler liquid. The heat developed in the passageway 22 is rejected in the heat exchanger 30, 32. While this heat exchanger operates on a conduction principle, it can be designed to be a very effective cooler because there are no limitations imposed upon it to meet electrical resistance requirements. It can, for example, have a cross section large enough and/or a length great enough to reject whatever heat is generated in the current limiters.

As was previously mentioned, the electromagnetic pump 50 pumps at a rate that varies directly with the current through the interrupter, providing higher rates of pumping as the current increases. The rate of cooling of the liquid metal in restricted zones 24 varies directly with the pumping rate. Thus, I have provided cooling means which can keep pace with the increased heating load imposed by higher currents, thus greatly increasing the capability of the current-limiters to carry high continuous currents without overheating.

The liquid metal in the hydraulic circuit loop has appreciable inertia which resists any very sudden change in its velocity despite a sudden change in the operating current through the pump 50. This inertia effect prevents the pump from increasing flow so rapidly as to significantly interfere with the desired rapid vaporization of liquid metal in the restricted zone 24 when the current rises abruptly toward its maximum prospective value upon initiation of a short circuit.

The electrically parallel relationship of two current limiters 12 and 14 enables me to distribute the total current through protector 8 approximately equally between the two current limiters under continuous-current conditions. In the event of a fault, one of the current limiters might operate slightly before the other, thus acting slightly before the other to develop high-pressure vapor and the resulting high resistance at its restricted zone. This would tend to force more current through the other current limiter, thus producing immediate operation of the other current limiter, thereby distributing the interrupting duty between the two current limiters. Under these conditions, the parallel path formed by the second-to-operate limiter does not detract from the performance of the first-to-operate limiter since the second-to-operate limiter quickly develops a high resistance which promotes current sharing between the two current-limiters.

Under continuous-current conditions, each current limiter forms a return path external to the other current limiter for liquid metal pumped through said other current limiter. This return path does not constitute a short circuit path for electrical current but rather a path having approximately the same resistance as the path through the other current limiter, thus producing the desired sharing of continuous current.

Figure 3:
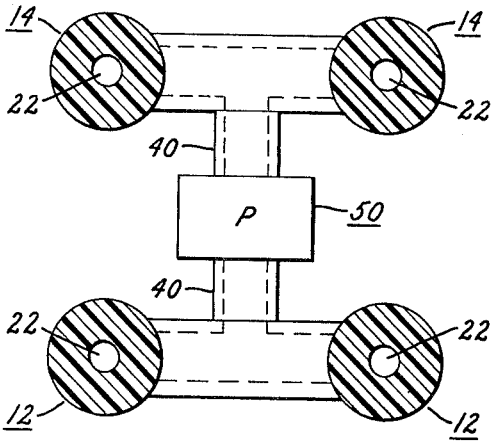
FIG. 3 is a schematic showing of a modified form of the invention as would be viewed from a transverse cross-sectional plane through the current-limiting devices 12 and 14.

While I have shown in detail a protector that comprises two current-limiters electrically connected in parallel, the invention also has application to a protector having a greater number of current limiters connected in parallel. Such a protector is schematically shown in FIG. 3, where there are four current limiters electrically in parallel. Two currentlimiters are located at each end of conduit 40. In the hydraulic circuit loop of the protector, the two limiters 12 at one end of conduit 40 are connected hydraulically in parallel with each other and hydraulically in series with the two current-limiters 14 at the other end of conduit 40. Pump 50 corresponding to pump 50 of FIGS. 1 and 2 pumps liquid metal around the circuit loop in generally the same manner as the pump 50 of FIGS. 1 and 2.

Although I have shown the heat exchanger 30, 32 in a conduit separate and distinct from the one in which pump 50 is located, it is to be understood that the invention in its broader aspects is not so limited. More specifically, the heat exchanger can be located either wholly or in part in the same conduit 40 as the pump 50. Preferably, however, the heat exchanger is located in a position where current can flow through the current limiting devices without passing through the heat exchanger.

Figure 4:
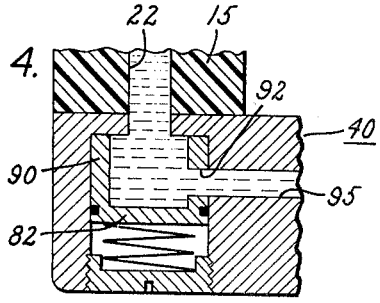
FIG. 4 is a sectional view illustrating a portion of a modified form of the invention.

As pointed out hereinabove, the pressure relief devices 80 serve to limit pressures within the protector to non-destructive values since the piston 82 in each pressurerelief device yields when the pressure thereabove reaches a predetermined level responsive to liquid-metal vaporization in a current limiting device. I can provide additional protection against such high pressure by using a modified form of pressure-relief device, or flow-control means, such as shown in FIG. 4. Here the piston 82 comprises a skirt 90 containing a hole 92 normally registering with the passage 95 in conduit 40. Normally, liquid metal can flow from the passage 22 of the current limiter into the passage 95 via hole 92; but when the pressure in passageway 22 reaches a predetermined value, it drives piston 82 downwardly to close off, or at least restrict the entrance to, passage 95 thus effectively isolating passage 95 from further pressure rises in the passageway 22. This effective isolation helps to protect the pump 50 of FIG. 1 from these further pressure rises. In one form of my invention, not specifically illustrated, a pressure-relief device such as shown in FIG. 4 is provided in all four terminals of the current limiters of FIG. 1. The pressure-relief devices in the upper terminals will help to protect the heat exchanger 30, 32 from excess pressures developed by liquid-metal vaporization in the current-limiting devices, and the pressure relief devices in the lower terminals will help to protect the pump 50 from these excess pressures.

While I have shown and described particular embodiments of my invention, it will be obvious to those skilled in the art that various changes and modifications may be made without departing from my invention in its broader aspects; and I, therefore, intend in the appended claims to cover all such changes and modifications as fall within the true spirit and scope of my invention.

What I claim as new and desire to secure by Letters Patent of the United States is:

1. A liquid-metal electric circuit protector comprising:

a. a plurality of liquid-metal current-limiting devices, each comprising:
   i. a tubular housing of electrical insulating material,
   ii. a pair of spaced electrical terminals at opposite ends of said housing, and
   iii. a passageway extending through said housing between said spaced terminals, b. a supply of a liquid metal which has a relatively low electrical resistivity in its liquid state and has a relatively high electrical resistivity in its vaporized state, a portion of said liquid metal supply normally being located within each of said passageways for normally carrying current between the spaced terminals of each of said current limiting devices and for vaporizing when shortcircuit current flows between said terminals, c. pumping means operated by current through said circuit protector during continuous current conditions for forcing said liquid metal through each of said passageways, d. return means for returning to one end of each of said passageways liquid metal discharging through the other end of said passageway, said return means including heat exchange means for cooling said liquid metal during its flow through said return means, and e. means for electrically connecting said current-limiting devices in parallel circuit relationship with each other;

and in which:

f. said passageways, said return means, and said pumping means constitute a hydraulic circuit loop through which said liquid metal normally circulates when said pumping means is operating, g. said pumping means is of the electromagnetic type and comprises a pair of spaced electrodes on opposite sides of liquid metal in said circuit loop between which current flows across said liquid metal when said pumping means is in operation, and an electromagnet for providing a magnetic field having flux lines extending across the portion of said circuit loop traversed by electric current passing between said electrodes in a direction transverse to the path of said current, h. said electrodes are electrically connected in series with said current-limiting devices, and i. said electromagnet comprises coil means electrically connected in series with said electrodes and said current limiting devices.

2. A liquid-metal electric circuit protector comprising:

a. a plurality of liquid-metal current-limiting devices, each comprising:
   i. a tubular housing of electrical insulating material,
   ii. a pair of spaced electrical terminals at opposite ends of said housing, and
   iii. a passageway extending through said housing between said spaced terminals, b. a supply of a liquid metal which has a relatively low electrical resistivity in its liquid state and has a relatively high electrical resistivity in its vaporized state, a portion of said liquid metal supply normally being located within each of said passageways for normally carrying current between the spaced terminals of each of said current limiting devices and for vaporizing when shortcircuit current flows between said terminals, c. means for hydraulically connecting said passageways in series in a hydraulic circuit loop, d. pumping means hydraulically connected in said loop and operated by current through said circuit protector during continuous current conditions for forcing said liquid metal around said loop via each of said passageways, e. heat exchange means external to said passageways for cooling said liquid metal during its flow through said loop, and f. means for electrically connecting said current-limiting devices in parallel circuit relationship with each other; and in which said pumping means is of the electromagnetic type and comprises:

g. a pair of spaced electrodes on opposite sides of liquid metal in said hydraulic circuit loop between which current flows across said liquid metal when said pump means is in operation, said electrodes being electrically connected in series with the electrically parallel combination of said current limiting devices, and h. a magnet for providing a magnetic field having flux lines extending across the portion of said hydraulic circuit loop traversed by electric current passing between said electrodes in a direction transverse to the path of said current.

3. The circuit protector of claim 2 in which said magnet is an electromagnet comprising coil means connected in series with said electrodes and said current-limiting devices.

4. A liquid-metal electric circuit protector comprising:

a. a plurality of liquid-metal current-limiting devices, each comprising:

i. a tubular housing of electrical insulating material, ii. a pair of spaced electrical terminals at opposite ends of said housing, and iii. a passageway extending through said housing between said spaced terminals, b. a supply of a liquid metal which has a relatively low electrical resistivity in its liquid state and has a relatively high electrical resistivity in its vaporized state, a portion of said liquid metal supply normally being located within each of said passageways for normally carrying current between the spaced terminals of each of said current limiting devices and for vaporizing when short-circuit current flows between said terminals, c. means for hydraulically connecting said passageways in series in a hydraulic circuit loop, d. pumping means hydraulically connected in said loop and operated by current through said circuit protector during continuous current conditions for forcing said liquid metal around said loop via each of said passageways, e. heat exchange means external to said passageways for cooling said liquid metal during its flow through said loop, and f. means for electrically connecting said current-limiting devices in parallel circuit relationship with each other;

g. additional current limiting devices of the type defined in (a) through (f), h. means for electrically connecting said additional current-limiting devices in parallel with the current limiting devices of (a) through (f), and i. means for hydraulically connecting each of said additional current limiting devices in said hydraulic circuit loop in series with each other and in parallel with one of said current-limiting devices of (a) through (f).

5. A liquid-metal electric circuit protector comprising:

a. a plurality of liquid-metal current-limiting devices, each comprising:

i. a tubular housing of electrical insulating material, ii. a pair of spaced electrical terminals at opposite ends of said housing, and iii. a passageway extending through said housing between said spaced terminals, b. a supply of a liquid metal which has a relatively low electrical resistivity in its liquid state and has a relatively high electrical resistivity in its vaporized state, a portion of said liquid metal supply normally being located within each of said passageways for normally carrying current between the spaced terminals of each of said current limiting devices and for vaporizing when short-circuit current flows between said terminals, c. means for hydraulically connecting said passageways in series in a hydraulic circuit loop, d. pumping means hydraulically connected in said loop and operated by current through said circuit protector during continuous current conditions for forcing said liquid metal around said loop via each of said passageways, e. heat exchange means external to said passageways for cooling said liquid metal during its flow through said loop, and f. means for electrically connecting said current-limiting devices in parallel circuit relationship with each other;

g. and flow control means between said current-limiting devices and said heat exchange means for restricting normal communication therebetween in response to the development of high pressures in said current-limiting devices produced by said liquid-metal vaporization.

6. The protector of claim 5 in which said flow control means comprises valve means between the passageways in said current-limiting devices and said heat exchange means, said valve means normally affording relatively free communication between said passageways and said heat exchanger but operating in response to pressure increases produced by said liquid-metal vaporization in said protector to restrict communication between said passageways and said heat exchange means.

7. A liquid-metal electric circuit protector comprising:

a. a plurality of liquid-metal current-limiting devices, each comprising:

i. a tubular housing of electrical insulating material, ii. a pair of spaced electrical terminals at opposite ends of said housing, and iii. a passageway extending through said housing between said spaced terminals, b. a supply of a liquid metal which has a relatively low electrical resistivity in its liquid state and has a relatively high electrical resistivity in its vaporized state, a portion of said liquid metal supply normally being located within each of said passageways for normally carrying current between the spaced terminals of each of said current limiting devices and for vaporizing when short-circuit current flows between said terminals, c. means for hydraulically connecting said passageways in series in a hydraulic circuit loop, d. pumping means hydraulically connected in said loop and operated by current through said circuit protector during continuous current conditions for forcing said liquid metal around said loop via each of said passageways, e. heat exchange means external to said passageways for cooling said liquid metal during its flow through said loop, and f. means for electrically connecting said current-limiting devices in parallel circuit relationship with each other;

g. and flow control means between said current limiting devices and said pumping means for restricting normal communication therebetween in response to the development of high pressures in said current-limiting devices produced by said liquid-metal vaporization.

8. A liquid-metal electric circuit protector comprising:

a. a plurality of liquid-metal current-limiting devices, each comprising:

i. a tubular housing of electrical insulating material, ii. a pair of spaced electrical terminals at opposite ends of said housing, and iii. a passageway extending through said housing between said spaced terminals, b. a supply of liquid metal which has a relatively low electrical resistivity in its liquid state and has a relatively high electrical resistivity in its vaporized state, a portion of said liquid metal supply normally being located within each of said passageways for normally carrying current between the spaced terminals of each of said current limiting devices and for vaporizing when short-circuit current flows between said terminals, c. means for hydraulically connecting said passageways in series in a hydraulic circuit loop, d. pumping means hydraulically connected in said loop and operated by current through said circuit protector during continuous current conditions for forcing said liquid metal around said loop via each of said passageways, e. heat exchange means external to said passageways for cooling said liquid metal during its flow through said loop, and f. means for electrically connecting said current-limiting devices in parallel circuit relationship with each other;

and in which:

g. said circuit protector includes terminals at its opposite ends, h. said heat exchanger is in a position wherein current can flow between said circuit protector terminals through said current-limiting devices without passing through said heat exchanger, and i. a conductor separate from said heat exchanger and interconnecting two of the terminals of said current limiting devices provides a bypass for said current around said heat exchanger.

* * * * *